US008402877B1

(12) United States Patent
Petrosillo et al.

(10) Patent No.: US 8,402,877 B1
(45) Date of Patent: Mar. 26, 2013

(54) PROTECTIVE BALLISTIC SHIELD

(75) Inventors: Frank Petrosillo, West Milford, NJ (US); Daniel Gennarelli, East Hanover, NJ (US); Louis Campanile, Denville, NJ (US); Chad Young, Macomb, MI (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 52 days.

(21) Appl. No.: 12/652,862

(22) Filed: Jan. 6, 2010

(51) Int. Cl.
*F41H 5/18* (2006.01)

(52) U.S. Cl. ..... 89/36.03; 89/919; 89/931

(58) Field of Classification Search ..... 89/36.13–36.15, 89/36.06–36.09, 36.01, 36.03, 36.04, 918, 89/919, 930, 931, 935
See application file for complete search history.

(56) References Cited

U.S. PATENT DOCUMENTS

| | | | | |
|---|---|---|---|---|
| 7,478,580 | B1 * | 1/2009 | Parimi et al. | 89/36.13 |
| 7,513,187 | B1 * | 4/2009 | Lambermont | 89/37.07 |
| D622,182 | S * | 8/2010 | Parimi et al. | D12/12 |
| 7,823,498 | B2 * | 11/2010 | Schneider et al. | 89/36.08 |
| 7,942,092 | B1 * | 5/2011 | Kiel et al. | 89/36.13 |
| 2007/0295199 | A1 * | 12/2007 | Elasic | 89/36.06 |
| 2009/0120274 | A1 * | 5/2009 | Schneider et al. | 89/36.08 |

* cited by examiner

*Primary Examiner* — Michael Carone
*Assistant Examiner* — Reginald Tillman, Jr.
(74) *Attorney, Agent, or Firm* — Michael C. Sachs

(57) ABSTRACT

An armor kit may include a weapon shield having a front plate with a weapon barrel opening and at least one window opening; a rotating outboard shield including a front panel connected to a center panel and a rear panel connected to the center panel, each of the front, center, and rear panels including a window opening and a window disposed over the window opening; a rotating inboard shield having an upper portion that is solid and a lower portion with a viewing aperture, the rotating inboard shield being located generally opposite the rotating outboard shield, the rotating inboard shield and the rotating outboard shield being simultaneously rotatable and maintaining fixed positions relative to each other; and a stationary inboard shield located in an interior of a circle of rotation of the rotating inboard shield and the rotating outboard shield.

18 Claims, 12 Drawing Sheets

PROTECTIVE BALLISTIC SHIELD

STATEMENT OF GOVERNMENT INTEREST

The inventions described herein may be manufactured, used and licensed by or for the U.S. Government for U.S. Government purposes.

BACKGROUND OF THE INVENTION

The invention relates in general to protective shields and in particular to shields for protection from ballistic threats.

Some mounted machine guns and artillery pieces may be equipped with metal armor plates to protect the gunners from sniper fire and shrapnel from explosions. Some gun shields may be improvised in the field using salvaged metal plates. In the Vietnam War, the crews of some armored fighting vehicles and PT Boats would affix metal plates to their machine guns. After the Vietnam War, gun shields fell out of widespread use.

Modern battlegrounds are filled with weapon fire. The weapon fire presents a grave risk to soldiers who may be exposed when firing at the enemy. The weapon fire may include incoming fire from elevated, precision-fire weapons, and ground-born threats, such as mines and improvised explosive devices. In particular, many casualties are hit in areas not protected by body armor or helmets, such as the neck or face. A disadvantage of gun shields may be that they limit the visibility of the user. In the case of vehicle-mounted guns, gun shields may also adversely affect the performance of tasks other than firing a gun.

Military tanks, such as the Abrams tank, may include a turret with one or more hatches. On the Abrams, one of the turret hatches is located at the tank commander's station. Mounted adjacent the tank commander's hatch may be a weapon, such as a .50 caliber machine gun. When using the .50 caliber machine gun, the tank commander may be vulnerable to enemy fire. A need exists for a protective shield for the operator of the weapon at the tank commander's station.

SUMMARY OF THE INVENTION

It is an object of the invention to provide a protective shield.

It is another object of the invention to provide a protective shield configured for the tank commander's station of a tank.

One aspect of the invention may be a weapon shield. The weapon shield may include a front plate having a weapon barrel opening and at least one window opening, a mounting bracket fixed to the front plate, transparent ballistic protection for the window opening, and an ammunition casing deflector fixed to the mounting bracket. At least a portion of the transparent ballistic protection may extend substantially across an entire width of the front plate.

The window opening may include a pair of generally L-shaped openings. The transparent ballistic protection may include a pair of generally L-shaped windows. Generally Z-shaped brackets may fix the windows to the front plate. The generally Z-shaped brackets may include side members extending generally perpendicular from Z-shaped portions of the brackets. A second portion of the transparent ballistic protection may be disposed on opposite sides of the weapon barrel opening.

Another aspect of the invention may be a protective shield assembly including a rotating outboard shield, a rotating inboard shield, and a stationary inboard shield. The rotating outboard shield may include three generally planar panels angularly connected to each other. The three panels may include a front panel connected to a center panel and a rear panel connected to the center panel. Each of the front, center, and rear panels may include an upper portion. The upper portion may have a window opening and a window disposed over the window opening.

The rotating inboard shield may have an upper portion that is solid and a lower portion with a viewing aperture. The rotating inboard shield may be located generally opposite the rotating outboard shield. The rotating inboard shield and the rotating outboard shield may be simultaneously rotatable and may maintain fixed positions relative to each other.

The stationary inboard shield may be located in the interior of a circle of rotation of the rotating inboard shield and the rotating outboard shield.

The rotating inboard shield may include an arcuate base having a tab opening therein. The lower portion of the rotating inboard shield may include a tab inserted in the tab opening in the arcuate base.

The stationary inboard shield may include separate front and rear shields. Each of the front and rear shields may include a window opening and a window disposed over the window opening. The front and rear shields may be substantially identical. Each of the front and rear shields may include a base with a tab opening, and a tab inserted in the tab opening.

A further aspect of the invention may be an armor kit. The armor kit may include a weapon shield having a front plate with a weapon barrel opening and at least one window opening. The armor kit may further include a rotating outboard shield, a rotating inboard shield, and a stationary inboard shield.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1A:
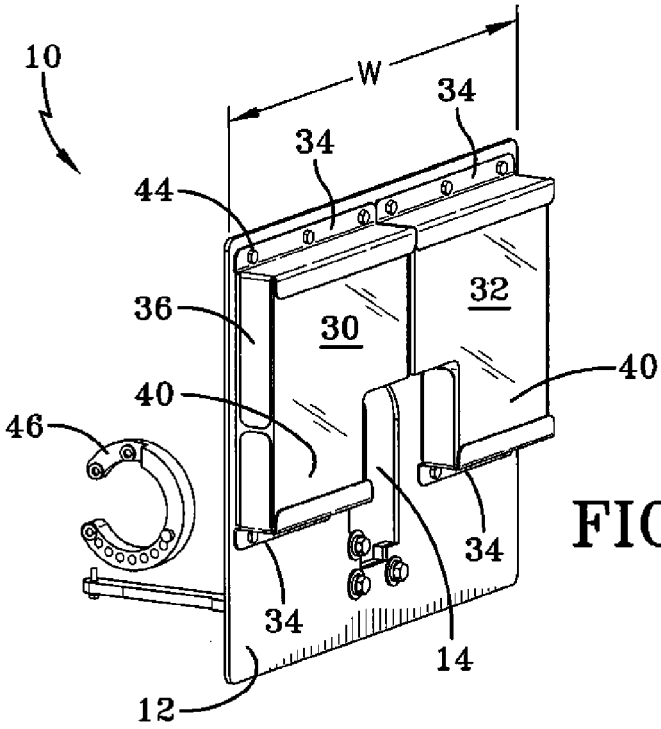
FIG. 1A is a perspective front view of one embodiment of a weapon shield.
Figure 1B:
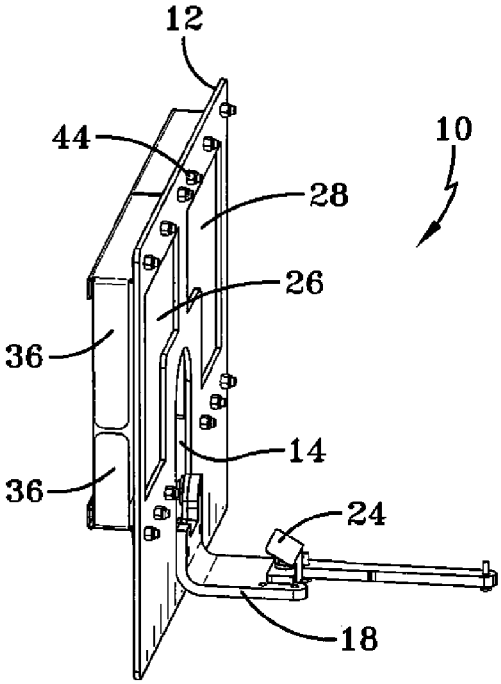
FIG. 1B is a perspective rear view of the shield of FIG. 1A.
Figure 1C:
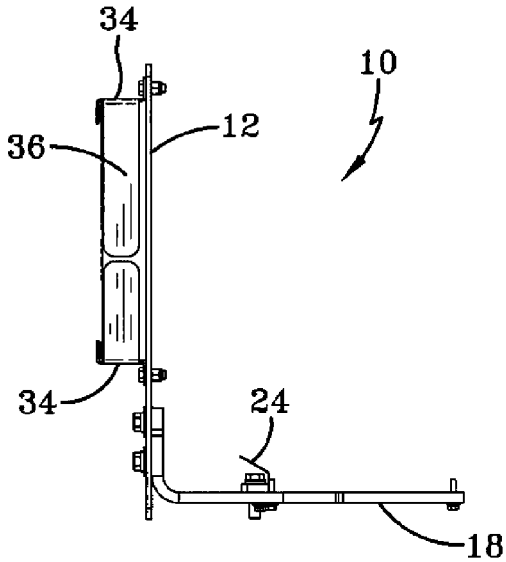
FIG. 1C is a side view of the shield of FIG. 1A.

Protective ballistic shields may provide cover, concealment and ballistic protection. The present invention may be used wherever ballistic protection may be needed. The disclosed embodiments may be useful, for example, for the operator of the M1A2 Abrams tank commander's weapon station. The shields may include shields mounted on the outboard and inboard side of the commander's weapon station. The shields may include stationary shields and rotating shields. Some shields may be fixed in place by bolting to pre-existing bolt holes on the commander's rotating weapon ring. Other shields may be fixed by clamping on the top of periscope blocks.

A front shield for the commander's weapon station may include a mounting bracket that clamps to the existing weapon cradle. A deflecting plate may deflect ammunition casings that have been ejected from the commander's weapon away from the mounting bracket. A ring tensioner may apply a load to the spring in the weapon cradle to offset the additional weight of the front shield and maintain balance within the weapon station.

Referring to FIGS. 1A-C and 2, one embodiment of a weapon shield 10 may include a front plate 12 having a weapon barrel opening 14 and at least one window opening. In the Figs., two window openings 26, 28 are shown. A mounting bracket 18 may be fixed to the front plate 12. The mounting bracket 18 may clamp to a weapon cradle and may include a bolt pattern for attaching the weapon shield 10 in front of a weapon. Front plate 12 may comprise, for example, steel. An exemplary thickness of the front plate 12 may be about one fourth of an inch.

Figure 2:
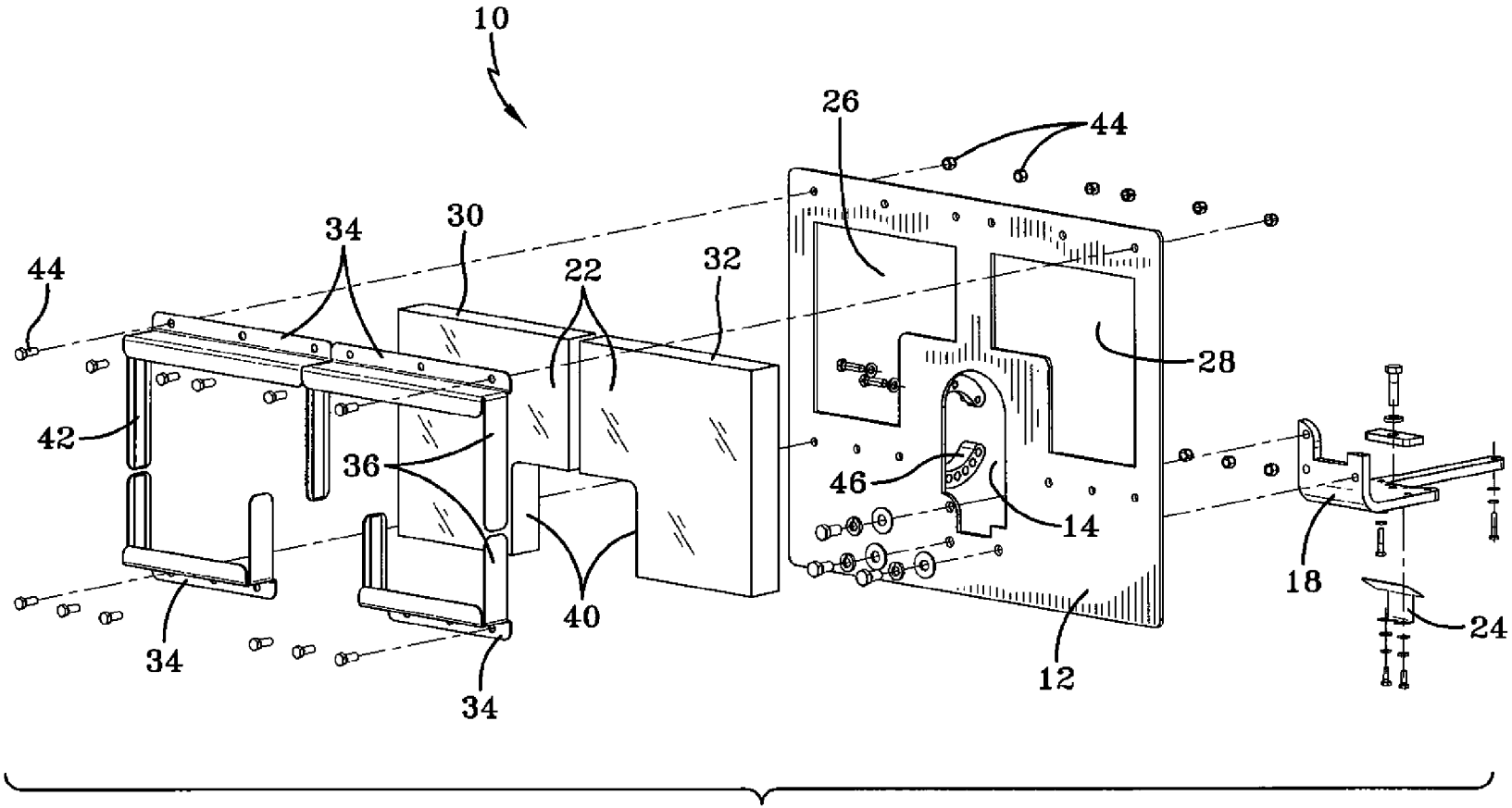
FIG. 2 is an exploded view of the shield of FIG. 1A.

The window openings 26, 28 may be covered with transparent ballistic protection. At least a portion 22 of the transparent ballistic protection may extend substantially across an entire width w (FIG. 1A) of the front plate 12. At least another portion 40 of the transparent ballistic protection may be disposed on opposite sides of the weapon barrel opening 14. In FIGS. 1A-C and 2, the transparent ballistic protection may include windows 30, 32. The window openings 26, 28 may be generally L-shaped and the windows 30, 32 may be correspondingly generally L-shaped. Windows 30, 32 may comprise, for example, laminated ballistic glass. An exemplary thickness of the windows 30, 32 may be about two inches. In FIG. 2, the portions 22 of windows 30, 32 may extend substantially across the entire width w of the front plate 12. In FIG. 2, the portions 40 of windows 30, 32 may be disposed on opposite sides of the weapon barrel opening 14.

Windows 30, 32 may be fixed to the front plate 12 using generally Z-shaped brackets 34 and fasteners 44. The generally Z-shaped brackets 34 may include side members 36 extending generally perpendicular from the Z-shaped portions of the brackets 34. Gasket material 42 may be disposed between surfaces of the brackets 34 and the windows 30, 32.

An ammunition casing deflector 24 may be fixed to the mounting bracket 18. The deflector 24 may deflect ejected casings from the commander's weapon around the mounting bracket 18. A ring tensioner 46 may apply a load to the spring (not shown) in the weapon cradle to offset the additional weight of the weapon shield 10 and maintain balance within the weapon station.

Figure 3:
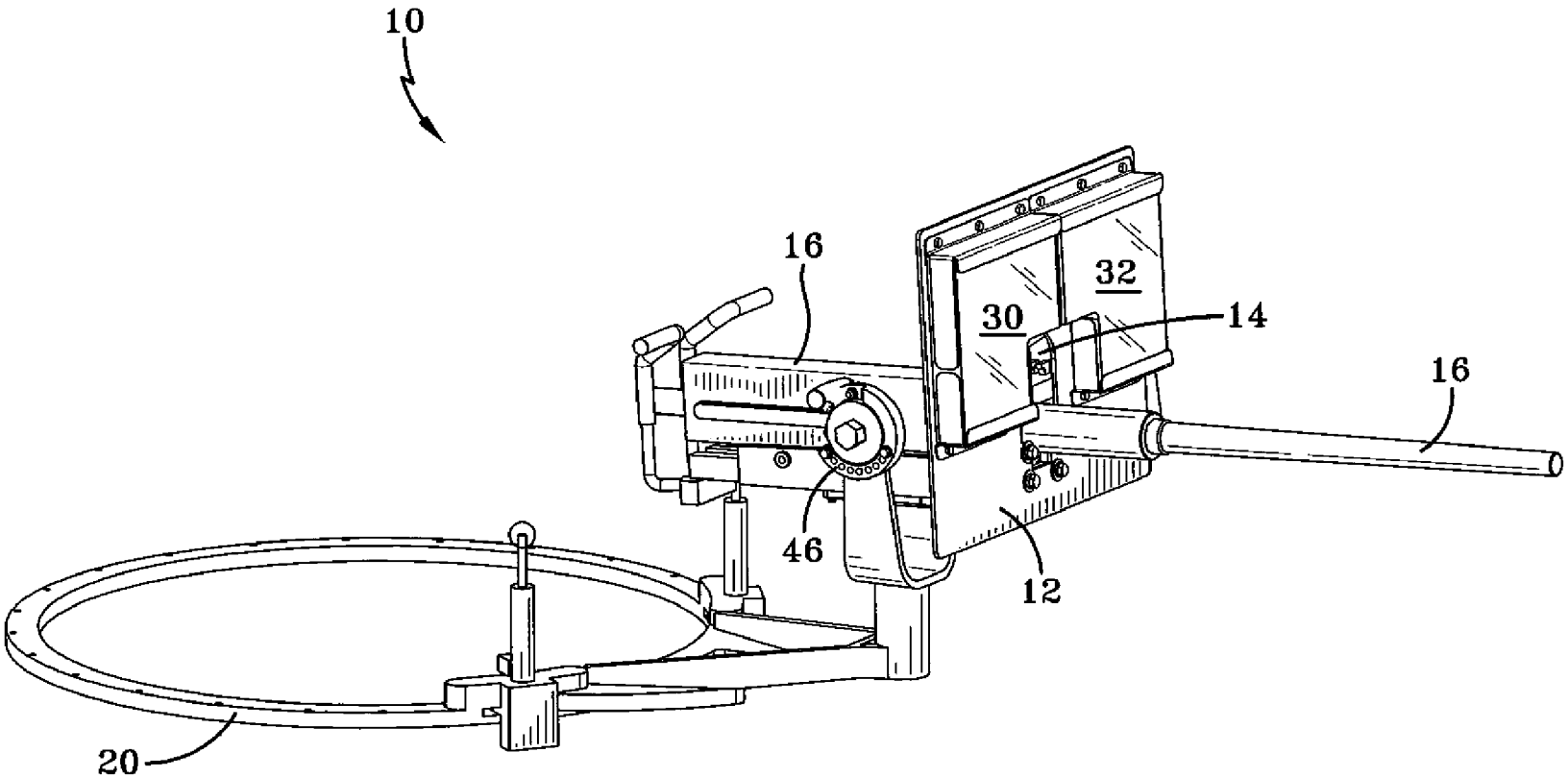
FIG. 3 is a perspective view of a weapon shield mounted to a weapon cradle.

FIG. 3 is a perspective view of the weapon shield 10 mounted to a weapon cradle that holds a machine gun 16. In FIG. 3, the weapon cradle is fixed to the bearing ring 20 of a turret. Bearing ring 20 may rotate.

Figure 4:
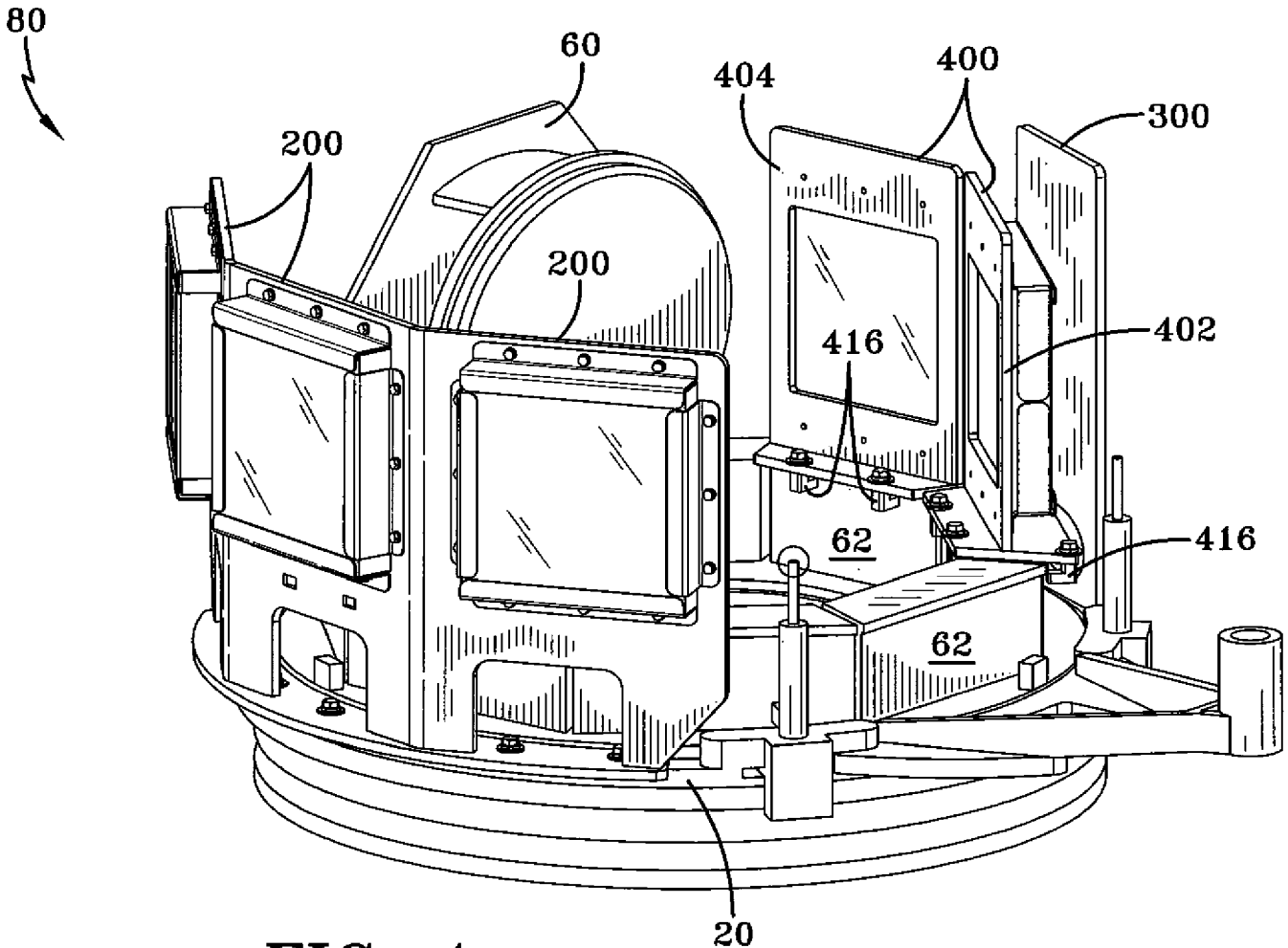
FIG. 4 is a perspective view of a protective shield assembly mounted on a vehicle.

In addition to weapon shield 10, additional shielding may be provided for the tank commander's station. FIG. 4 is a perspective view of a protective shield assembly 80 mounted at a weapon station, such as the commander's station of an M1A2 Abrams tank. The weapon 16, weapon cradle, and weapon shield 10 of FIG. 3 are not shown in FIG. 4. The protective shield assembly 80 shown in FIG. 4 may include a rotating outboard shield 200, a stationary inboard shield 400, and a rotating inboard shield 300. When fixed in an open position, the hatch cover 60 may also provide ballistic protection.

Rotating outboard shield 200 and rotating inboard shield 300 may be fixed to the rotating bearing ring 20 for rotation with the weapon 16 and the weapon shield 10. Stationary inboard shield 400 may be fixed to top surfaces of the periscope blocks 62, which do not rotate. Rotating inboard shield 300 may be located generally opposite the rotating outboard shield 200. Rotating inboard shield 300 and rotating outboard shield 200 may be simultaneously rotatable on ring 20. Thus, shield 300 and shield 200 may maintain fixed positions relative to each other. Stationary inboard shield 400 may be located in the interior of the circle of rotation (defined by, for example, ring 20) of the rotating inboard shield 300 and the rotating outboard shield 200.

Figure 5:
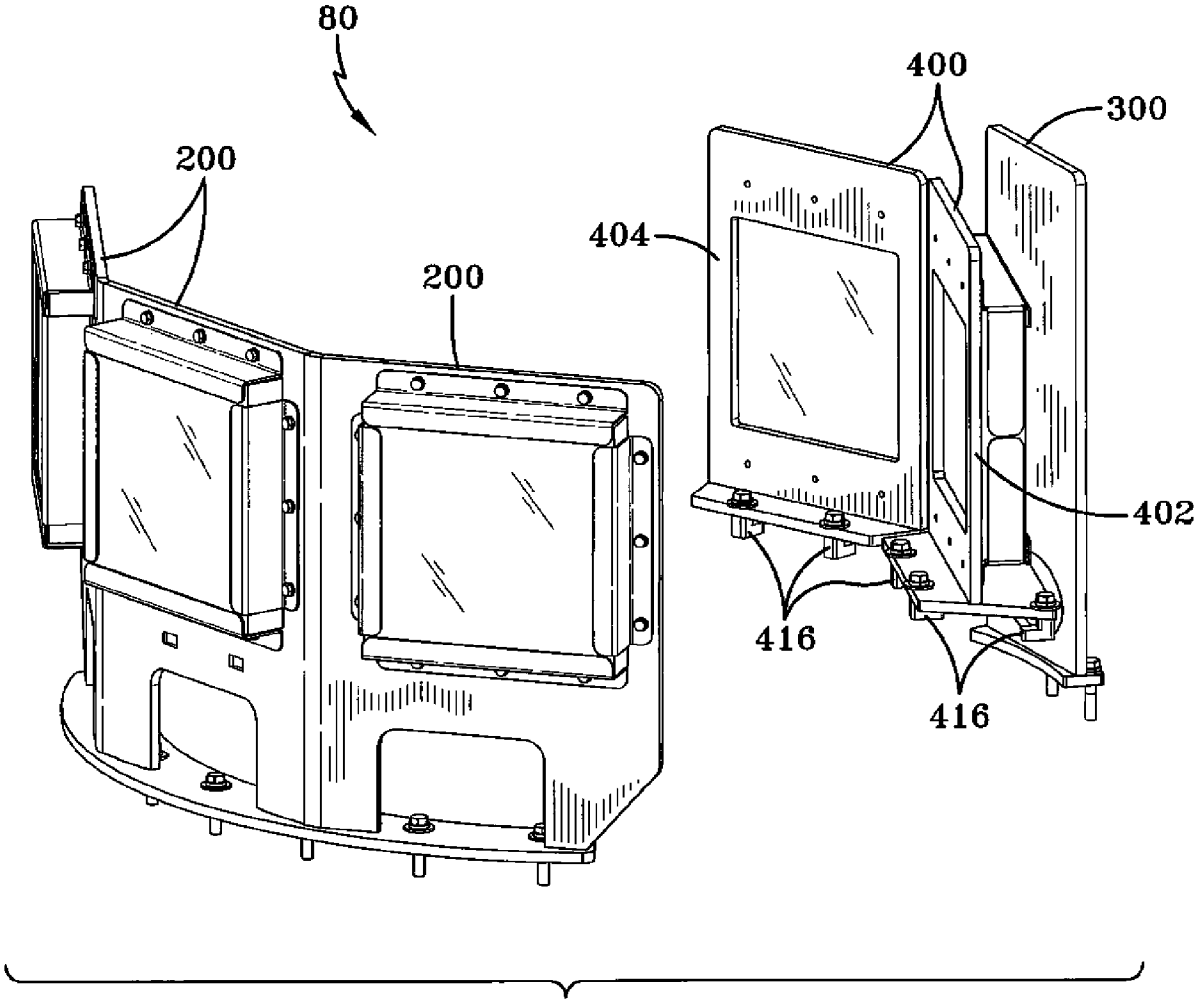
FIG. 5 is a perspective view of the protective shield assembly of FIG. 4.

FIG. 5 is a perspective view of the protective shield assembly 80 including rotating outboard shield 200, stationary inboard shield 400, and rotating inboard shield 300. The shields 200, 300, and 400 are each described in more detail below.

Figure 6:
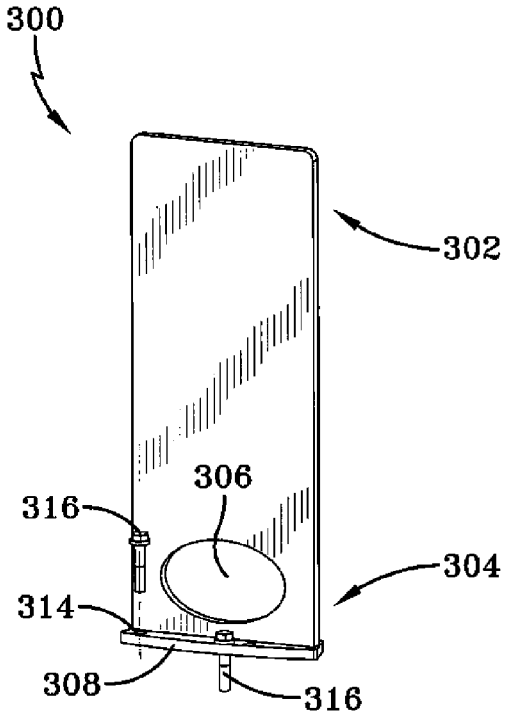
FIG. 6 is a perspective view of a rotating inboard shield.
Figure 8:
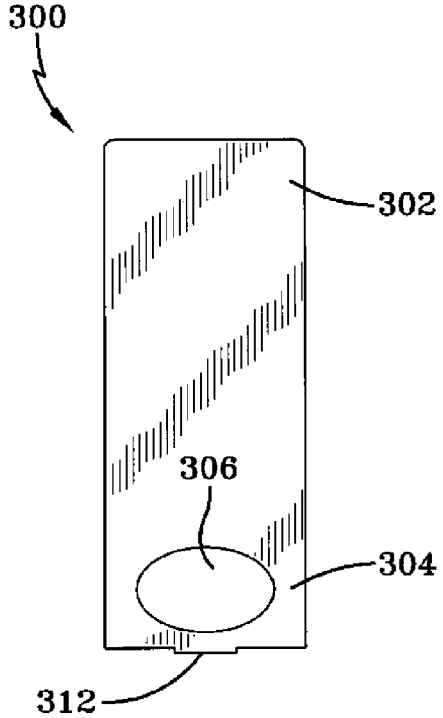
FIG. 8 is a front view of the shield of FIG. 6, without the base attached.
Figure 7:
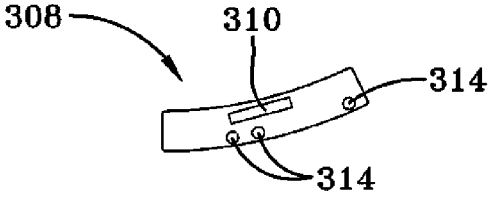
FIG. 7 is top view of a base for the rotating inboard shield of FIG. 6

FIG. 6 is a perspective view of a rotating inboard shield 300. FIG. 7 is top view of a base 308 for the rotating inboard shield 300. FIG. 8 is a front view of the shield 300, without the base 308 attached. Rotating inboard shield 300 may include an upper portion 302 that is solid and a lower portion 304 with a viewing opening 306. Viewing opening 306 may provide an unobstructed area for viewing through the periscopes in periscope blocks 62 (FIG. 4). Rotating inboard shield 300 may be substantially planar and may comprise, for example, steel. The steel may have a thickness of, for example, about 0.5 inches.

Rotating inboard shield 300 may include an arcuate base 308 (FIG. 7) having a tab opening 310 therein. The lower portion 304 of the rotating inboard shield 300 may include a tab 312 (FIG. 8) that may be inserted in the tab opening 310 in the arcuate base 308. Base 308 may include openings 314 through which fasteners 316 may be inserted for securing shield 300 to, for example, ring 20 (FIG. 4).

Stationary shield 400 (FIG. 4) may include a stationary front shield 402 and a stationary rear shield 404 that may be substantially identical to each other. Shields 402 and 404 may be fixed to upper surfaces of periscope blocks 62 (FIG. 4) with clamps 416. Periscope blocks 62 may not rotate. Because shields 402 and 404 may be substantially identical, only the front shield 402 will be described in further detail.

Figure 9:
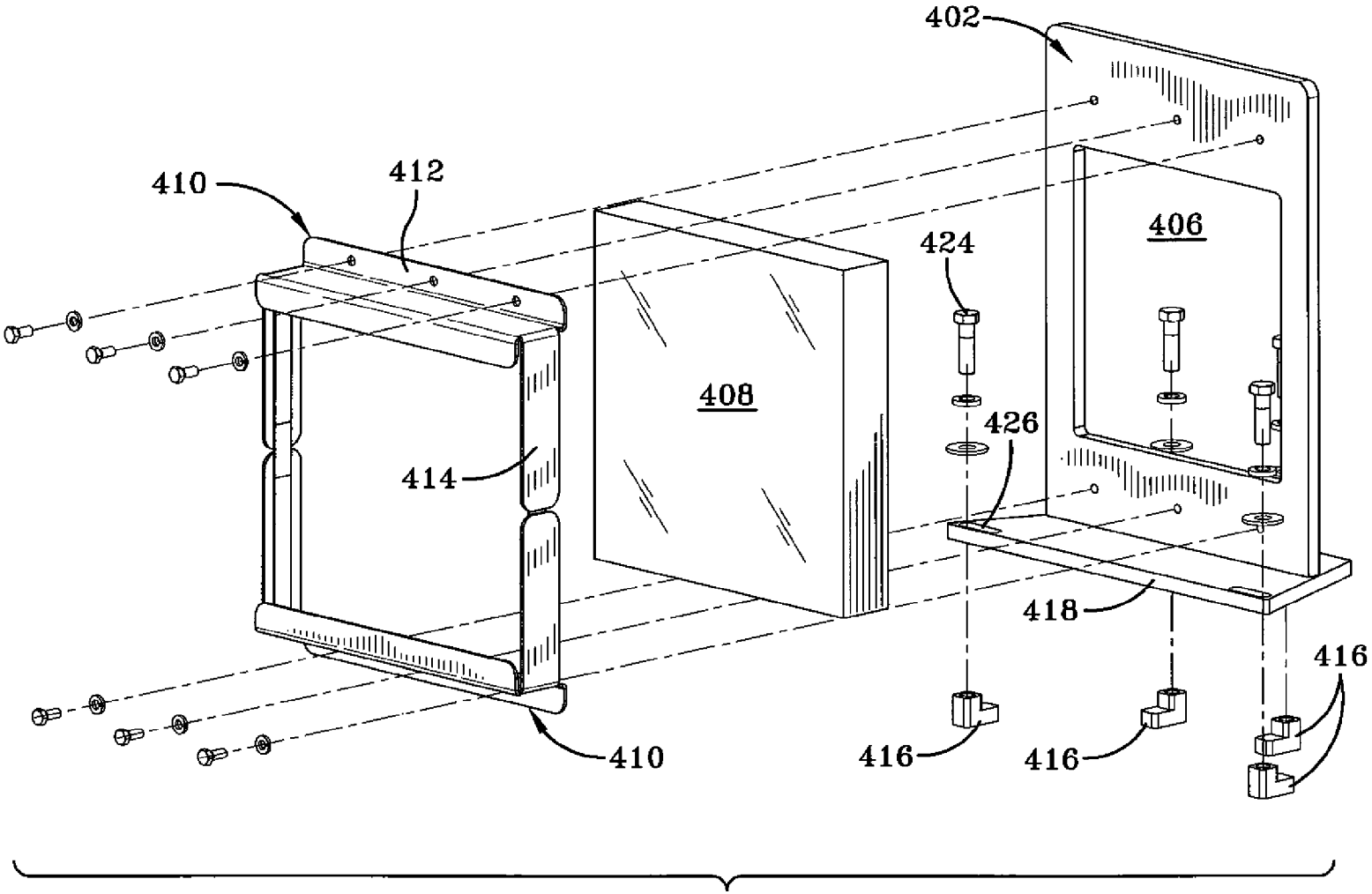
FIG. 9 is an exploded perspective view of a stationary shield.
Figure 10:
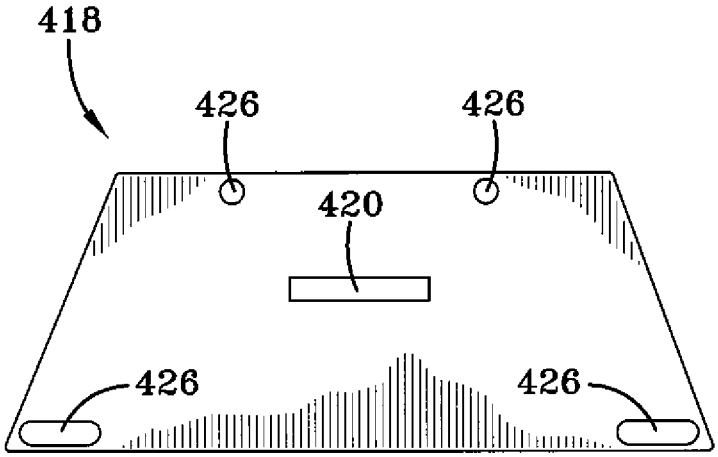
FIG. 10 is a top view of a base for the stationary shield of FIG. 9.
Figure 11:
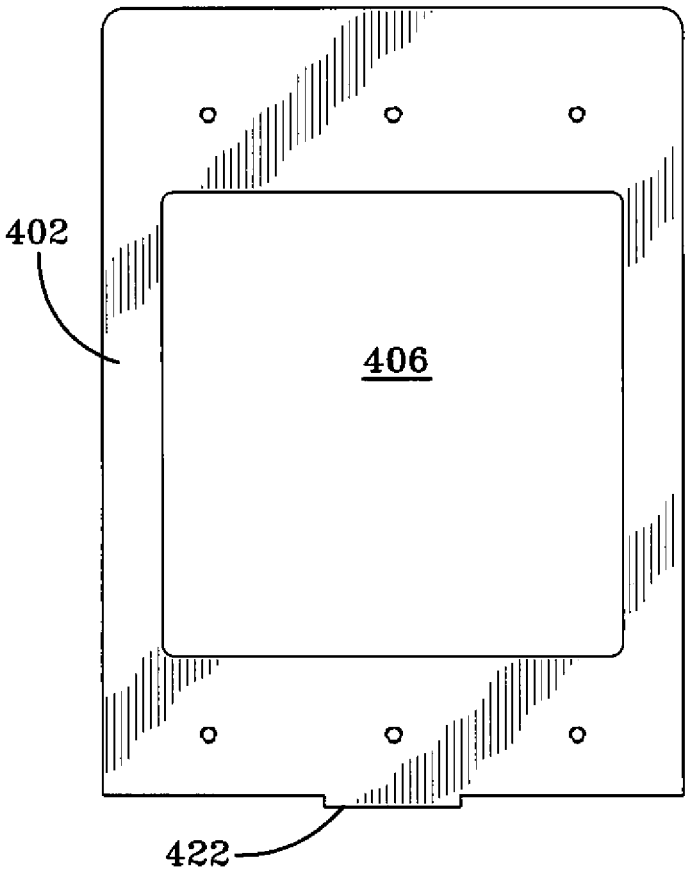
FIG. 11 is a front view of a stationary shield, without the base.

FIG. 9 is an exploded perspective view of a stationary front shield 402. FIG. 10 is a top view of a base 418 for the stationary shield 402 of FIG. 9. FIG. 11 is a front view of the stationary shield 402, without the base 418. Shield 402 may include a window opening 406 and a window 408 disposed over the window opening 406. Window 408 may be made of, for example, laminated ballistic glass having a thickness of about two inches. Shield 402 may be generally planar and may comprise, for example, steel. The steel may have a thickness of, for example, about 0.50 inches.

Window 408 may be fixed over opening 406 using generally Z-shaped brackets 410. Brackets 410 may include a generally Z-shaped portion 412 and side members 414 that extend substantially perpendicular from the generally Z-shaped portion 412. Gasket material may be inserted between the bracket 410 and edges of window 408.

Figure 12:
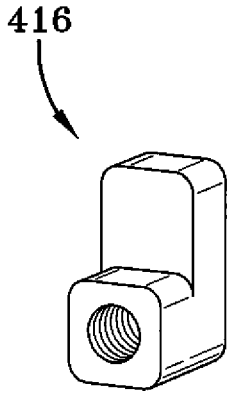
FIG. 12 is a perspective view of a clamp.

Shield 402 may include a base 418 (FIG. 10) having a tab opening 420 and fastener openings 426. Shield 402 may include a tab 422 (FIG. 11) that may be inserted in tab opening 420 in base 418. Clamps 416 (FIG. 12) may be used to fix shield 402 to, for example, periscope blocks 62 (FIG. 4) using fasteners 424 (FIG. 9).

Figure 13A:
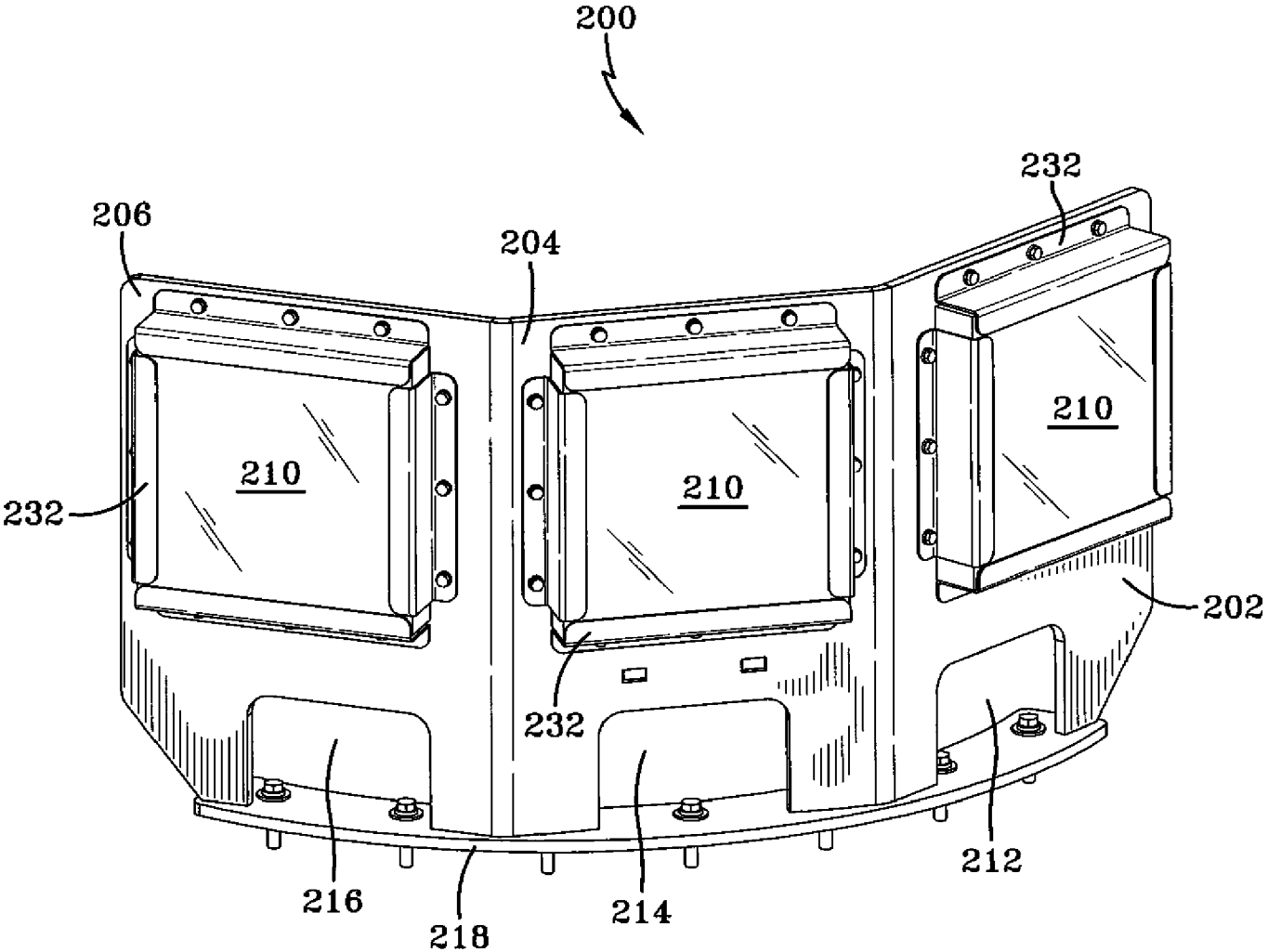
FIGS. 13A and B are perspective views of the exterior and interior, respectively, of a rotating outboard shield.

FIGS. 13A and B are perspective views of the exterior and interior, respectively of a rotating outboard shield 200. Shield 200 may include three generally planar panels angularly connected to each other. The three panels may include a front panel 202 connected to a center panel 204 and a rear panel 206 connected to the center panel 204. Each of the front, center, and rear panels 202, 204, 206 may include an upper portion having a window opening 208 and a window 210 disposed over the window opening 208. Windows 210 may be made of, for example, laminated ballistic glass having a thickness of, for example, about two inches.

Figure 15A:
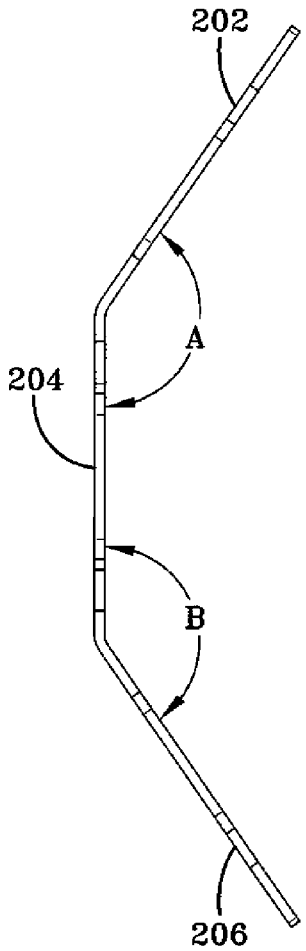
FIGS. 15A and B are bottom and side views, respectively, of panels for a rotating outboard shield.

FIGS. 15A and B are bottom and side views, respectively, of panels for rotating outboard shield 200. Front panel 202 may form an angle A (FIG. 15A) with center panel 204 and rear panel 206 may form an angle B with center panel 204. Angles A and B may be a same angle or different angles. Angles A and B may be in a range of about forty-five to about sixty-five degrees. In one embodiment, angles A and B are about fifty-five degrees.

Panels 202, 204, 206 may be made of, for example, steel. The steel may have a thickness of, for example, about 0.50 inches. Each of the front, center and rear panels 202, 204, 206 may include a lower portion having a viewing opening 212, 214, 216 therein. Viewing openings 212, 214, 216 may provide unobstructed areas for viewing through the periscopes in periscope blocks 62 (FIG. 4).

Figure 14:
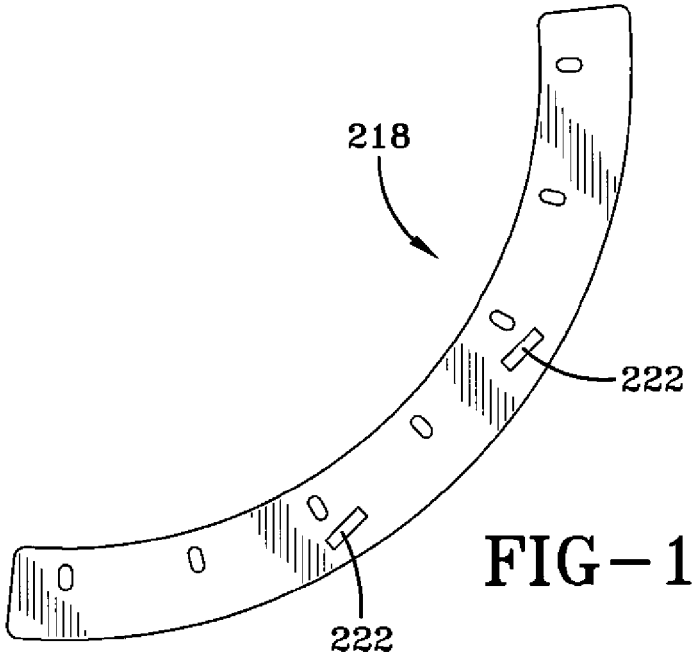
FIG. 14 is a top view of a base member for a rotating outboard shield.

Outboard shield 200 may include a generally arcuate base member 218. FIG. 14 is a top view of a base member 218 for rotating outboard shield 200. Arcuate base member 218 may include tab openings 222 therein. Center panel 204 may include tabs 224 (FIG. 15B) formed on a lower portion thereof. The tabs 224 may be inserted in the tab openings 222 of the arcuate base member 218.

Figure 13B:
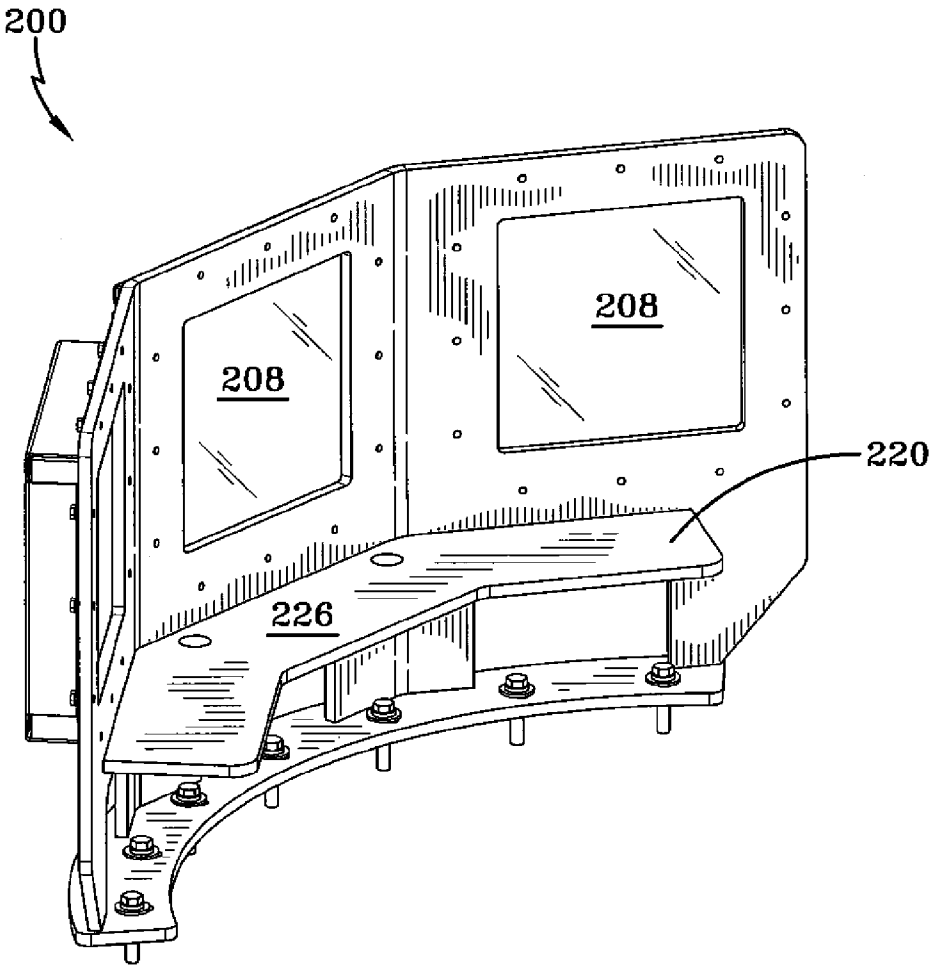
Figure 16:
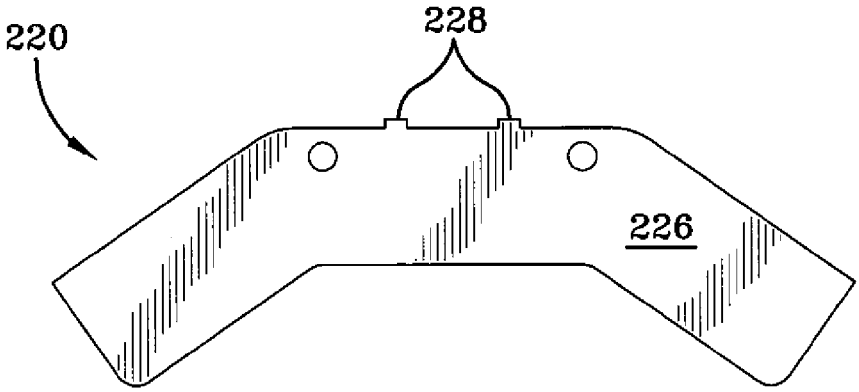
FIG. 16 is a top view of a sill for a rotating outboard shield.
Figure 15B:
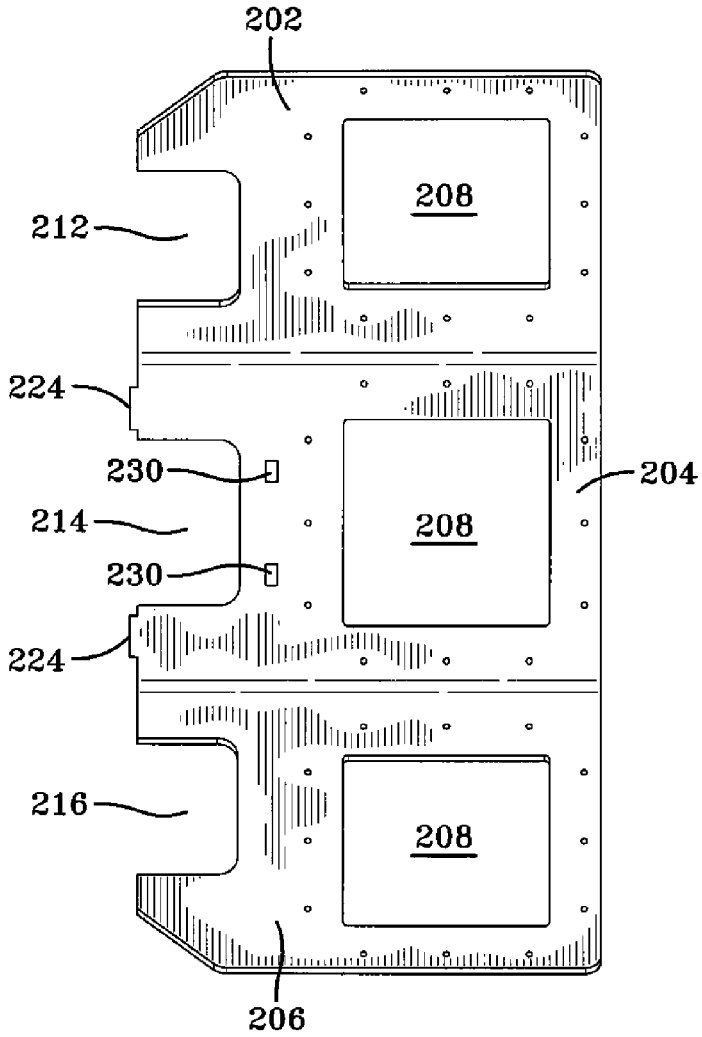

FIG. 16 is a top view of a sill 220 for rotating outboard shield 200. Sill 220 may be disposed in an interior of the front, center, and rear panels 202, 204, 206 (FIG. 13B). Sill 220 may include a generally horizontal upper face 226. Sill 220 may include at least one tab 228 (FIG. 16) that may be inserted in at least one tab opening 230 in the center panel 204 (FIG. 15B). Sill 220 may help to block enemy fire that may enter through the viewing openings 212, 214, 216.

Windows 210 may be fixed over window openings 208 using generally Z-shaped brackets 232 (FIG. 13A). Brackets 232 may be similar to brackets 410 shown in FIG. 9, but without the side members 414.

Weapon shield 10, rotating outboard shield 200, rotating inboard shield 300, and stationary inboard shield 400 may provide much improved ballistic protection for a weapon operator. In particular, weapon shield 10, rotating outboard shield 200, rotating inboard shield 300, and stationary inboard shield 400 may provide much improved ballistic protection for the operator of the weapon at the commander's station of an M1A2 Abrams tank.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A protective shield assembly for a hatch on an M1A2 Abrams tank at the tank commander's weapon station, said shield assembly comprising:

a rotating outboard shield including three generally planar panels angularly connected to each other, the three panels including a front panel connected to a center panel and a rear panel connected to the center panel, each of the front, center, and rear panels including an upper portion, the upper portion having a window opening and a window disposed over the window opening, and wherein each of the front, center, and rear panels include a lower portion, the lower portion having a viewing opening therein;

a substantially planar rotating inboard shield having an upper portion that is solid and a lower portion with a viewing aperture, the rotating inboard shield being located generally opposite the rotating outboard shield, the rotating inboard shield and the rotating outboard shield being simultaneously rotatable and maintaining fixed positions relative to each other; and a stationary inboard shield located in an interior of a circle of rotation of the rotating inboard shield and the rotating outboard shield.

2. The assembly of claim 1, wherein the rotating inboard shield comprises steel having a thickness of about 0.5 inches.

3. The assembly of claim 1, wherein the rotating inboard shield includes an arcuate base having a tab opening therein and the lower portion of the rotating inboard shield includes a tab inserted in the tab opening in the arcuate base.

4. The assembly of claim 1, wherein the stationary inboard shield comprises separate planar front and rear shields, each of the front and rear shields including a window opening and a window disposed over the window opening.

5. The assembly of claim 4, further comprising generally Z-shaped brackets for fixing all the windows over their respective windows openings.

6. The assembly of claim 5, wherein the generally Z-shaped brackets include side members extending substantially perpendicular to Z-shaped portions of the generally Z-shaped brackets.

7. The assembly of claim 5, wherein the front and rear shields are substantially an identical shield.

8. The assembly of claim 7, wherein each of the front and rear shields includes a base with a tab opening, and a tab inserted in the tab opening.

9. The assembly of claim 8, further comprising clamps for fixing the base to a periscope block.

10. The assembly of claim 1, wherein the rotating outboard shield includes an arcuate base member, the arcuate base member including tab openings therein.

11. The assembly of claim 10, wherein the center panel includes tabs on the lower portion, the tabs being inserted in the tab openings of the arcuate base member.

12. The assembly of claim 1, wherein the rotating outboard shield includes a sill disposed in an interior of the front, center, and rear panels, the sill including a generally horizontal upper face.

13. The assembly of claim 12, wherein the sill includes at least one tab inserted in at least one tab opening in the center panel.

14. An armor kit for a hatch on an M1A2 Abrams tank at the tank commander's weapon station, the armor kit providing cover, concealment and ballistic protection for its operator, said armor kit further comprising:

a weapon shield having a front plate with a weapon barrel opening and at least one window opening;

a rotating outboard shield including three generally planar panels angularly connected to each other, the three panels including a front panel connected to a center panel and a rear panel connected to the center panel, each of the front, center, and rear panels including an upper portion, the upper portion having a window opening and a window disposed over the window opening;

a rotating inboard shield having an upper portion that is solid and a lower portion with a viewing aperture, the rotating inboard shield being located generally opposite the rotating outboard shield, the rotating inboard shield and the rotating outboard shield being simultaneously rotatable and maintaining fixed positions relative to each other; and a stationary inboard shield located in an interior of a circle of rotation of the rotating inboard shield and the rotating outboard shield.

15. The armor kit of claim 14, wherein the weapon shield further comprises a mounting bracket fixed to the front plate; transparent ballistic protection for the window opening; and an ammunition casing deflector fixed to the mounting bracket; wherein at least a portion of the transparent ballistic protection extends substantially across an entire width of the front plate and at least a second portion of the transparent ballistic protection is disposed on opposite sides of the weapon barrel opening.

16. The armor kit of claim 14, wherein each of the front, center, and rear panels of the rotating outboard shield includes a lower portion, the lower portion having a viewing opening therein.

17. The armor kit of claim 14, wherein the window openings comprise a pair of generally L-shaped openings with a first portion having transparent ballistic protection comprising a pair of generally L-shaped windows and at least a second portion having transparent ballistic protection disposed on opposite sides of the weapon barrel opening.

18. The armor kit of claim 17, wherein the transparent ballistic protection comprises laminated ballistic glass.

* * * * *